United States Patent [19]

College et al.

[11] Patent Number: 4,924,693

[45] Date of Patent: May 15, 1990

[54] RAM ACTUATING MECHANISM IN A PRESS FOR TERMINATING WIRES

[75] Inventors: David A. College, Harrisburg; Keith Johnson, Jr., Manheim; Joseph F. Stachura, Palmyra; Herman D. Walter, Marysville, all of Pa.

[73] Assignee: AMP Incorporated, Harrisburg, Pa.

[21] Appl. No.: 285,465

[22] Filed: Dec. 16, 1988

[51] Int. Cl.[5] ..... B21J 9/18

[52] U.S. Cl. ..... 72/453.03; 72/452; 100/270; 100/292

[58] Field of Search ..... 72/453.03, 453.04, 452; 100/270, 271, 282, 291, 292, 238

[56] References Cited

U.S. PATENT DOCUMENTS

| | | | |
|---|---|---|---|
| 1,913,663 | 6/1933 | Ferris | 72/453.04 |
| 2,573,333 | 10/1951 | Hillix . | |
| 2,780,117 | 2/1957 | Bauer et al. | 72/453.04 |
| 3,141,197 | 7/1964 | Hahn . | |
| 3,191,411 | 6/1965 | Sitz . | |
| 3,484,922 | 12/1969 | Fritz et al. . | |
| 3,867,754 | 2/1975 | Koch et al. . | |
| 4,411,062 | 10/1983 | Folk et al. . | |
| 4,559,807 | 12/1985 | Ganago et al. | 72/453.03 |
| 4,588,539 | 5/1986 | Rossi et al. . | |
| 4,646,555 | 3/1987 | Postupack | 72/453.03 |
| 4,765,044 | 8/1988 | Wilson et al. . | |

FOREIGN PATENT DOCUMENTS

| | | |
|---|---|---|
| 0139368 | 2/1985 | European Pat. Off. . |

*Primary Examiner*—David Jones

*Attorney, Agent, or Firm*—James M. Trygg

[57] ABSTRACT

The present invention relates to a ram actuating mechanism in a press for terminating wires, or the like. The actuating mechanism imparts movement to the ram in two distinct portions. An air cylinder or other low pressure linear actuator is utilized to effect the relatively long stroke of the first portion of movement. The second portion of movement, which must overcome relatively high insertion forces but over a relatively short distance is effected by a cam and cam follower arrangement. This permits sufficient clearance between the terminating punch and die when the ram is retracted to pass other wire handling mechanisms while at the same time providing a relatively compact mechanism.

9 Claims, 2 Drawing Sheets

RAM ACTUATING MECHANISM IN A PRESS FOR TERMINATING WIRES

The present invention relates to a ram actuating mechanism in a press for terminating wires in an automated machine wherein the ram may be retracted sufficiently to permit passage of wire handling apparatus between the ram and the base.

BACKGROUND OF THE INVENTION

Presses for terminating wires by crimping a terminal onto an end thereof, require the ability to apply a substantial amount of force during the actual crimping. Such presses therefore, employ flywheel eccentrics, cams or toggles to impart motion to the ram and provide sufficient force to effect the crimp. A typical example of a flywheel operated press is shown in U.S. Pat. No. 3,343,398 which issued Sept. 26, 1967 to Kerns. This type of press is necessarily large due to the use of a stored energy flywheel which itself must be massive. The flywheel press, while effective as a stand-alone machine, is not easily integrated into an automated machine for manufacturing wire harness products or the like. One reason for this is that in order to achieve a sufficiently long ram stroke, about three inches or so, to allow clearance for the operation of wire feed mechanisms when the press ram is fully retracted, the flywheel press must be inordinately large.

Toggle and cam operated presses, on the other hand can be made quite compact. An example of a typical toggle actuated press is shown in U.S. Pat. No. 3,141,197 which issued July 21, 1967 to Hahn. Hahn shows a wire terminating press having a toggle mechanism actuated by an air cylinder. Toggle mechanisms, however, tend to be limited to imparting a very short stroke to the ram. Therefore, when the ram is fully retracted, there is insufficient clearance for the wire handling mechanisms to pass under the ram. Similarly cam operated presses can also be made quite compact. An example of such a press is shown in U.S. Pat. Application Ser. No. 07/222654, filed on July 21, 1988 by Hatfield and assigned to the present assignee. Hatfield utilizes a cam which engages a follower attached to the end of the cam in such a way that as the cam is rotated, the ram is caused to move a distance equal to the lift function of the cam. But, here again, this mechanism imparts a relatively short stroke to the ram. One way to lengthen the stroke is by means of a high lift cam which is necessarily substantially larger and more massive. This of course defeats attempts to provide a compact device that will easily integrate into an automated machine.

What is needed is a ram actuating mechanism that permits sufficient ram stroke to provide clearance for wire handling mechanisms and yet is compact and easily integrated into an automated machine.

SUMMARY OF THE INVENTION

The present invention relates to a ram actuating mechanism in a press for terminating wires, or the like. The press includes a frame, a base, and a ram carried by the frame, the ram and base being arranged for mutually opposed reciprocating movement. An actuating means is provided for effecting the reciprocating movement which comprises a first linkage means for causing a first portion of the movement and a second linkage means for causing a second portion of the movement. The first portion of movement occurs over a substantially greater distance than does the second portion of movement.

The second linkage means includes a cam and cam follower operationally engaged therewith for effecting the second portion of movement.

BRIEF DESCRIPTION OF THE PREFERRED EMBODIMENT

Figure 1:
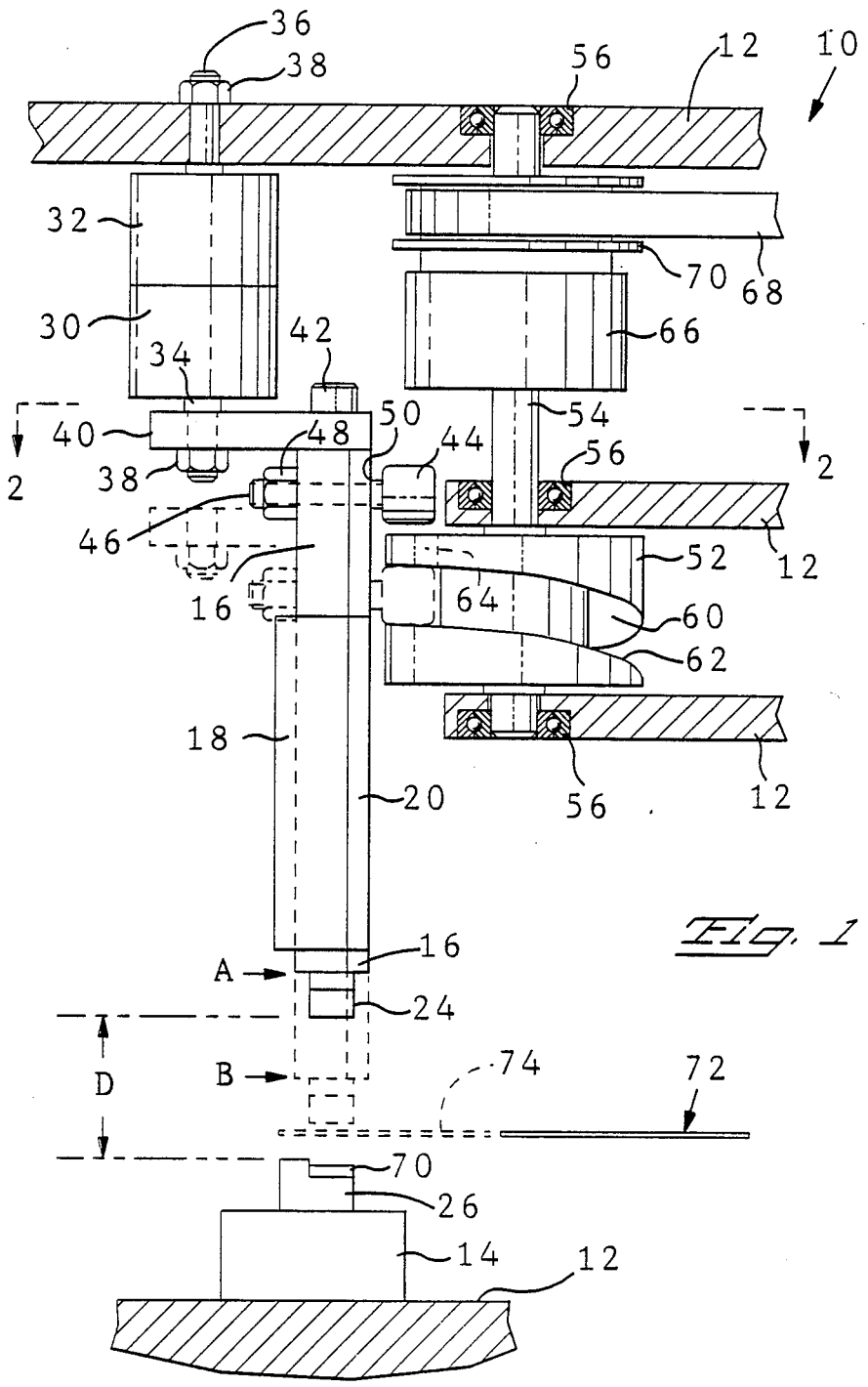
FIG. 1 is a side view of a portion of an automated machine showing the reciprocating ram and associated actuating mechanism in accordance with the teachings of the present invention.
Figures 2, 3:
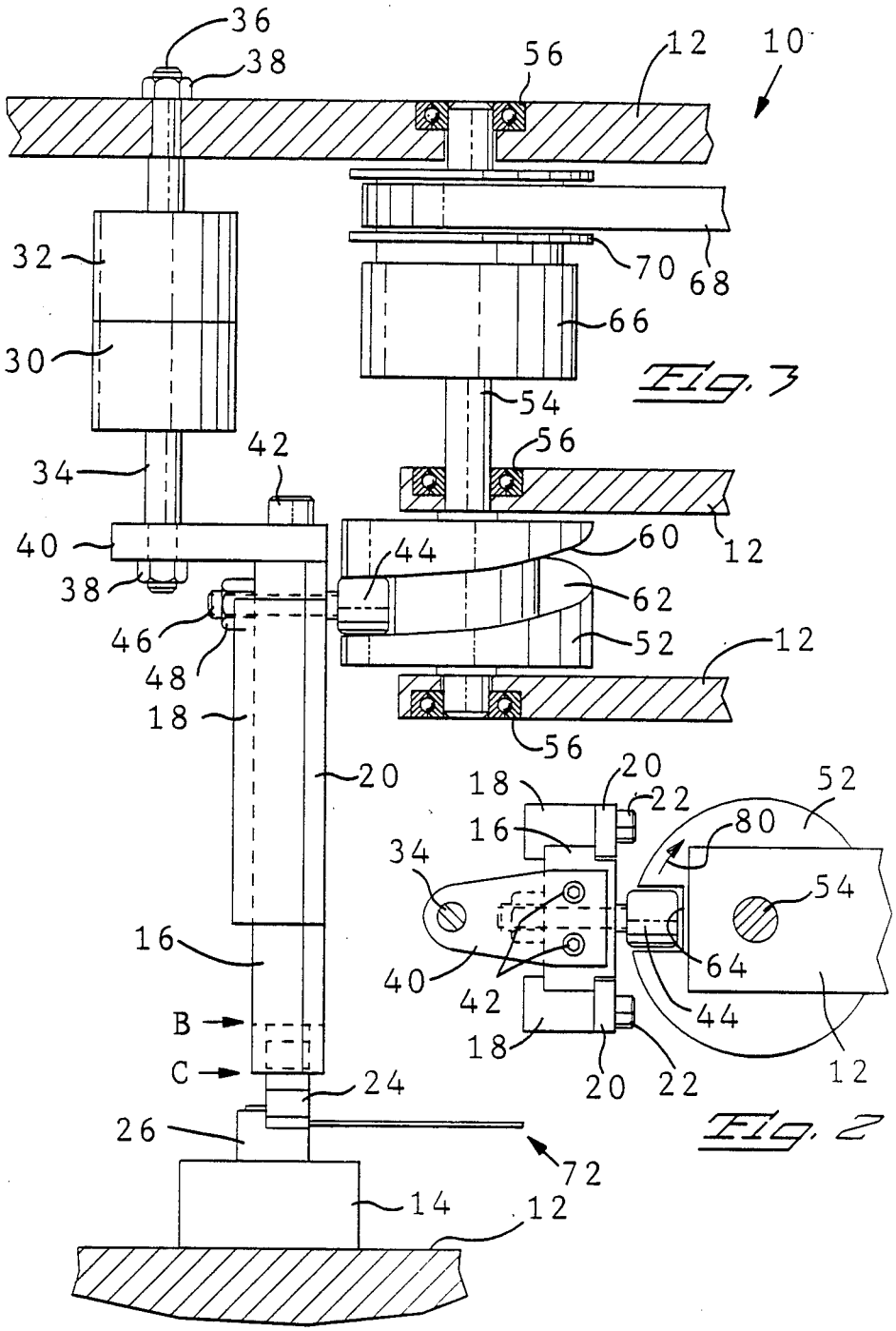
FIG. 2 is a cross-sectional view of the actuating mechanism of FIG. 1 taken along the lines 2-2.
FIG. 3 is a view similar to that of FIG. 1 showing the ram fully extended in the crimping position.

There is shown in FIGS. 1, 2, and 3 a portion of an automated machine 10 having a frame 12. The machine 10 can be any of a number of automated wire handling and processing machines well known in the industry, see for example, U.S. Pat. No. 4,136,440, which issued Jan. 30, 1979 to Brandewier et al., which is incorporated herein by references. Brandewier discloses a machine for fabricating an electrical harness having multi-contact electrical connectors and a plurality of wires of diverse lengths attached thereto. The present disclosure sets for the ram actuating mechanism for such an automated machine.

The machine 10 includes a base 14 carried by the frame 12 as shown in FIGS. 1 and 3. A ram 16 is slidingly held in a slideway 18 which is rigidly attached to the frame 12 in any convenient manner. The slideway 18 includes a pair of gib plates 20 which are attached to the slideway 18 by means of the screw fasteners 22. The slideway 18 and base 14 are arranged so that the ram 16 may undergo opposed reciprocating movement with respect to the base 14. Suitable wire insertion tooling is provided including a punch 24 removably attached to the ram 16 and a die and connector housing holder assembly 26 removably attached to the base 14, as shown in FIG. 1. While the present example illustrates wire insertion into insulation displacement type terminals, suitable tooling maybe provided for crimp type terminations or the like.

A pair of air cylinders 30 and 32 have their respective housings attached end to end so that their respective shafts 34 and 36 are in mutual alignment and project outwardly in opposite directions as shown in FIG. 1. The shaft 36 is attached to the frame 12 by means of the nut 38, in the usual manner, and the other shaft 34 is similarly attached to a bracket 40. The bracket 40 is also attached to an end of the ram 16 by a pair of screw fasteners 42 in cantilever fasion as shown in FIGS. 1 and 2. The pair of air cylinders 30 and 32, in the present example, are model numbers FO-17-2.00-P3-CFT and FO-17-1.25-BR-P3-CFT respectively, manufactured by Bimba Manufacturing Company of Monee, Illinois. A crowned cam follower 44 and mounting stud 46 are attached to the ram 16 by means of a nut 48. The stud 46 passes through a hole in the ram 16 and the nut 48 pulls a shoulder 50 of the stud 46 against the side of the ram 16 and holds the cam follower 44 securely in place. The cam follower used in the present example is part number CRSC-24, manufactured by Torrington Company of South Bend, Indiana.

A barrel cam 52 having a drive shaft 54 is journaled for rotation in the frame 12 by means of the bearings 56 in the usual manner. The cam 52 has upper and lower cam surfaces 60 and 62 which are spaced to loosely engage the cam follower 44. An opening 64, as seen in FIG. 2, is provided in the upper cam surface 60 and is sized to permit passage therethrough by the cam follower 44. The purpose of the opening 64 will be explained below. The drive shaft 54 is coupled to a driving motor, not shown, by means of a single revolution clutch package 66 and drive belt 68. The clutch package 66 is solenoid operated by applying a voltage to the solenoid field windings in the usual manner. The drive belt 68 is continuously driven by the driving motor so that the clutch pully 70 is in continuous rotation while the drive shaft 54 is stationary. When it is desired to rotate the drive shaft 54, and thereby the cam 52, the solenoid windings are energized thereby coupling the pully 70 to the drive shaft 54 and causng rotation thereof. Any suitable single revolution clutch package 66 may be used. In the present example the clutch 66 comprises an intermittent drive assembly Model Number IDA-10, manufactured by Hilliard Corporation of Elmira, New York.

Prior to describing the operation of the ram actuating mechanism of the present invention, it should be pointed out that the reciprocating movement of the ram 16 comprises a first portion of movement and a second portion of movement. The first portion of movement is that which the ram 16 undergoes when moving from its fully retracted position clear of the cam 52 as indicated at A in FIG. 1, to the position indicated by phantom lines at B. This first portion of movement is effected by a first linkage maans comprising the pair of air cylinders 30 and 32 and the bracket 40. That total movement, from A to B. amounts to about two inches in the present example. The second portion of movement is that which the ram 16 undergoes when moving from the position indicated at B in FIGS. 1 and 3 to its fully extended position which is indicated at C in FIG. 3. This second portion of movement is effected by a second linkage means comprising the cam follower 44, the cam 52, and the cam driving apparatus 54, 66, 70, and 68. That total movement is about one inch and includes the actual engagement of the wire and termination thereof into a contact within a connector housing. As will now be described, the first portion of movement is effected by the air cylinder 30 while the second portion of movement is effected exclusively by the cam 52 acting upon the cam follower 44.

In operation, a connector housing 70 is automatically advanced into position in the die assembly 26 as shown in FIG. 1. An array 72 of parallel, spaced wires, a single wire in some cases, is advanced to a position indicated by the phantom lines 74 intermediate the connector housing 70 and the punch 24. The air cylinder 30 is then pressurized causing the shaft 34, bracket 40, ram 16, and cam follower 44 to undergo the first portion of movement downwardly, as viewed in FIG. 1, until the ram 16 is in the position B. Note that, in this position, the cam follower 44 has passed through the opening 64 and is brought into engaging position between the upper and lower cam surfaces 60 and 62 respectively. The stroke of the shaft 34 is chosen so that when fully extended, the cam follower 44 is advanced into engaging position without bottoming against the cam surface 62 and possibly damaging the surface or the follower. Once the cylinder 30 has fully extended the shaft 34, the solenoid of the clutch 66 is energized, causing the drive shaft 54 and the cam 52 to begin rotating in a direction indicated by the arrow 80 in FIG. 2. This causes the opening 64 to move clockwise and the cam surfaces 60 and 62 to captivate the follower 44. At the same instant rotation of the cam 52 begins, the air cylinder 32 is pressurized forcing the cam follower onto the lower cam surface 62, much as a biasing spring would. As rotation of the cam 52 continues and the punch 24 engages the array 72 of wires and begins to insert them into contacts within the connector housing 70, the forces caused thereby begin to build and resist the downward motion of the ram 16. When these forces exceed the force applied to the ram 16 by the air cylinder 32, the follower 44 will shift very slightly from the surface 62 into engagement with the cam surface 60. It is this surface 60 which drives the follower 44 and the ram 16 to its fully extended position C where the array 72 of wires is fully inserted as shown in FIG. 3. Note, that as the ram 16 approaches this fully extend position, the force which must be applied to the ram 16 by means of the follower 44 and cam 52 is at a maximum. To achieve this maximum force, the drive motor and cam surface geometry are carefully selected and matched to minimize the mass and bulk of the components. As rotation of the cam 52 continues in the clockwise direction, as viewed in FIG. 2, the pressure in the cylinder 32 is reversed so that it acts as a biasing spring in the upward direction, as viewed in FIG. 3, and at the same instant, the cam follower 44 begins to track upwardly along the upper cam surface 60 to the position shown in phantom lines in FIG. 1. At this point the cam 52 has completed one revolution and the single revolution clutch 66 automatically disengages from the pully 70 and stops the cam 52 in the position shown in FIG. 2. Once the cam 52 has stopped, the pressure in the air cylinder 30 is reversed so that the shaft 34 retracts the bracket 40, ram 16 and follower 44 upwardly, the follower 44 passing through the opening 64, until the ram 16 is positioned as at A in FIG. 1. At this point, the punch 24 has retracted upwardly from the die assembly 26 a full three inches, as indicated at D in FIG. 1. This provides sufficient clearance for the insertion, operation, and retraction of wire handling mechanisms and connector housing loading devices. Such mechanisms and devices are common in the industry and, for example, are shown in U.S. Pat. No. 4,136,440 which was mentioned above.

A very important feature of the present invention is the ability of the ram actuating mechanism to impart movement to the ram in two distinct portions. The first portion of movement occurs over a relatively greater distance than does the second portion of movement, while the second portion of movement permits the ram to apply relatively greater force to the terminating punch and die set than would be possible by the first portion of movement. This in turn permits a relatively compact and effective actuating mechanism that can be easily integrated into an automated environment.

We claim:

1. In a press for terminating wires, having a frame, a base, and a ram, said ram and base being associated with said frame and arranged for mutually opposed reciprocating movement with respect thereto, actuating means for effecting said reciprocating movement comprising a first linkage means for causing a first portion of said movement and a second linkage means for causing a second portion of said movement which effects said termination, wherein said first portion of movement occurs over a substantially greater distance than does said second portion of movement, said second linkage means including a barrel cam having a camming surface circumscribing the cam 360° and cam follower operationally engaged therewith for effecting said second portion of movement, said second linkage means further including means for driving said cam one complete revolution of 360°.

2. The press set forth in claim 1 wherein said cam follower is in said operational engagement with said cam only during said second portion of said movement.

3. The press set forth in claim 2 wherein said first linkage means includes means for effecting said first portion of movement and for moving said cam follower from a position clear of said barrel cam into engaging position with said cam.

4. The press set forth in claim 3 wherein said second linkage means is arranged so that when said cam follower is in operational engagement with said cam, said second portion of movement is effected independent of said first linkage means.

5. The press set forth in claim 4 wherein said means for effecting said first portion of said movement is a linear actuator and said linear actuator is arranged so that as said first portion of movement is being concluded, said linear actuator brings said cam follower into engaging position with said cam.

6. The press set forth in claim 5 wherein said linear actuator is an air cylinder attached to said ram and said cam follower is attached to said ram, said cam having a cam surface for said operational engagement with said cam follower, said cam surface having an opening therein through which said cam follower is caused to pass by said air cylinder while bringing said cam follower into engaging position with said cam.

7. The press set forth in claim 6 wherein said engaging position of said cam follower is when said cam follower is adjacent said cam surface so that upon rotation of said cam, said cam follower is brought into operational engagement therewith.

8. The press set forth in claim 7 wherein said cam surface is an upper cam surface and said cam includes a lower cam surface spaced from said upper cam surface to loosely engage and captivate said cam follower when in said operational engagement therewith.

9. The press set forth in claim 8 including a single revolution clutch package operationally connected with said means for driving said cam so that upon activation of said clutch, rotational movement of 360° is imparted to said cam.

* * * * *